United States Patent [19]

Geyer et al.

[11] 4,166,756

[45] Sep. 4, 1979

[54] RAILROAD CAR FRICTION CASTING METALLURGY

[75] Inventors: Robert P. Geyer, Palatine; Kenneth F. Veasman, Naperville, both of Ill.; Vilakkudi G. Veeraraghavan, Coshocton, Ohio

[73] Assignee: Standard Car Truck Co., Chicago, Ill.

[21] Appl. No.: 892,142

[22] Filed: Mar. 31, 1978

[51] Int. Cl.[2] ..... C22C 37/00

[52] U.S. Cl. ..... 148/35; 75/123 CB

[58] Field of Search ..... 75/123 CB, 125, 128 D; 148/2, 3, 35, 138, 141

[56] References Cited

U.S. PATENT DOCUMENTS

| | | | |
|---|---|---|---|
| 2,200,765 | 5/1940 | Bartholomew et al. | 148/141 |
| 2,324,322 | 7/1943 | Reese et al. | 148/35 |
| 2,352,408 | 6/1944 | Reece et al. | 148/3 |
| 3,095,300 | 6/1963 | Moore et al. | 75/123 CB |
| 3,299,482 | 1/1967 | Tache et al. | 75/123 CB |
| 3,784,416 | 1/1974 | Davies | 148/141 |

*Primary Examiner*—L. Dewayne Rutledge
*Assistant Examiner*—Peter K. Skiff
*Attorney, Agent, or Firm*—Kinzer, Plyer, Dorn & McEachran

[57] ABSTRACT

A process for the manufacture of railroad car truck components with high wear resistant qualities involves an alloy of specific composition, dumping from the sand mold above a specific temperature and being allowed to cool in air, resulting in an "as cast" acicular microstructure having very little amounts of Pearlite and carbides. This process eliminates the heat treating, quenching and draw operations normally associated with the production of wear resistant, acicular castings.

8 Claims, 1 Drawing Figure

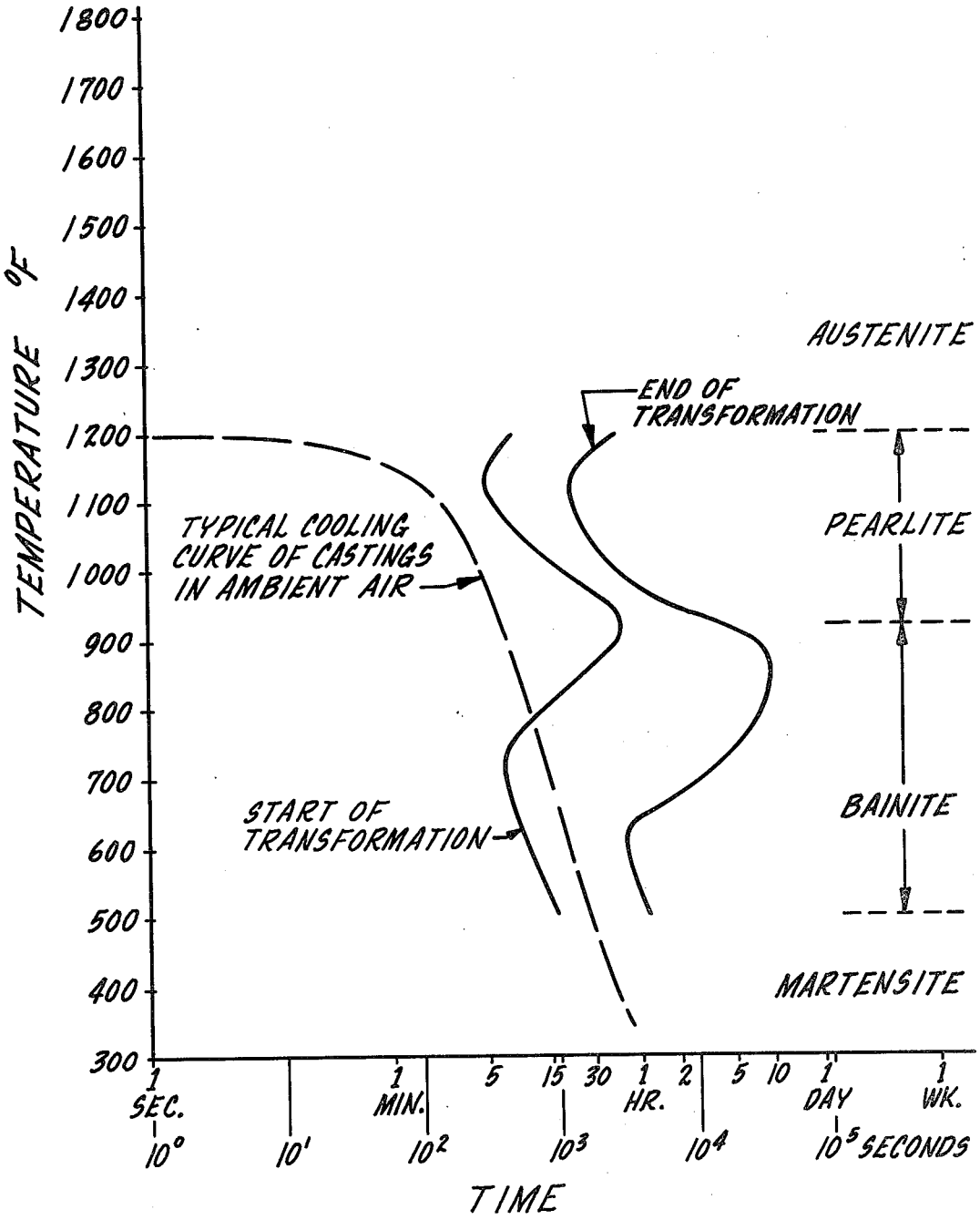
1800
1700
1600
1500
1400
1300
1200
1100
1000
900
800
700
600
500
400
300
TEMPERATURE °F
AUSTENITE
END OF TRANSFORMATION
PEARLITE
TYPICAL COOLING CURVE OF CASTINGS IN AMBIENT AIR
BAINITE
START OF TRANSFORMATION
MARTENSITE
1 SEC.
1 MIN.
5
15
30
1 HR.
2
5
10
1 DAY
1 WK.
10⁰
10¹
10²
10³
10⁴
10⁵ SECONDS
TIME

RAILROAD CAR FRICTION CASTING METALLURGY

SUMMARY OF THE INVENTION

The present invention relates to the metallurgy of wear resistant damping elements used in railroad car trucks. Specifically, this invention relates to the chemical composition and process control parameters such as the pouring temperature, dumping from the mold temperature, and subsequent cooling rate in order to develop the desired microstructure in the castings. These castings in their finished "as cast" condition will have an acicular microstructure predominantly of Martensite and Bainite with less than maximum permissible amounts of retained Austenite, Pearlite and carbides.

Details of the metallurgical specifications and the properties and applications of the resulting cast iron will appear in the ensuing specification, drawing and claims.

BRIEF DESCRIPTION OF THE DRAWING

The present invention is illustrated diagrammatically in the following continuous cooling, time-temperature-transformation diagram describing the transformation of a casting from Austenite to the various transformation products for an alloy of nominal composition.

DESCRIPTION OF THE PREFERRED EMBODIMENT

The present invention relates to wear resistant iron castings of the type used in damping systems on railway freight car trucks. The specific metallurgical process disclosed herein may, however, have wider applications. The described metallurgical process provides a cast iron with an "as cast" acicular microstructure predominantly of Martensite and Bainite, with some retained Austenite, but with no more than five percent Pearlite and traces of carbide. Pearlite is highly undesirable as it permits rapid and excessive wear of the casting, whereas carbides make the castings too brittle and harder than desirable. The finished casting will have a Brinell hardness of between 302 and 415.

The specific chemical composition of the casting is as follows:

| Element | Percent by Weight |
|---|---|
| Carbon | 3.00–3.30 |
| Silicon | 1.20–1.50 |
| Manganese | 0.85–1.00 |
| Molybdenum | 0.80–0.90 |
| Copper and/or Nickel | 1.40–1.60 |
| Iron (plus minor sulphur and phosphorous elements) | Balance |

The process for forming castings for the described use and with the above chemistry is critical. The hot metal should be poured into the ladle at a temperature that will produce defect-free castings, preferably between 2600°–2650° F. The tapping temperature should be consistent and the hot metal poured into the molds before the inoculant fades, usually within three minutes. The length of time the castings stay in the mold, 30–60 minutes in the case of a typical friction casting, should be optimized such that the temperature of the castings at the dump is above 1250° F. and preferably around 1400° F. As will appear hereinafter, the dumping temperature is important to avoid the formation of Pearlite.

When the castings are dumped from the sand mold, the sand and castings are separated permitting the castings to cool individually in an established temperature environment to ambient temperature with no other heat treatment required.

It has been determined that the ladle of hot metal must be sufficiently inoculated to avoid undercooling and the formation of massive carbides. The inoculant should be any silicon bearing commercial product having a known silicon composition so that the amount used can be calculated to increase the hot metal silicon level 0.14–0.17 percent.

Referring to the drawing, a typical time-temperature-transformation diagram for an alloy of nominal composition, as long as the metal is held at a temperature above 1200° F. it will remain in a stable Austenitic state. When the iron is cooled below 1200° F. the Austenitic phase becomes unstable and transformations will take place with the passing of time. Since it is important to avoid any transformation into Pearlite, and in fact, to provide a transformation that results in substantially Martensite and Bainite, it is necessary to dump the casting from the mold at a temperature in which the casting is in a stable Austenitic state. Cooling the castings above a critical cooling rate from the Austenitic state, as indicated in the drawing, allows the casting to avoid a transformation into Pearlite or, at the most, a minimum amount of Pearlite. Ambient cooling of the castings from a temperature above 1250° F. is adequate to obtain the desired transformation product, as can be seen from the drawings.

As a specific example of the process described herein and the specific chemistry disclosed, an alloyed iron having the following composition was tapped into the ladle at a temperature of 2645° F., inoculated in the ladle with an inoculant known as SMZ, a product of Union Carbide, at a rate of 6 lbs./ton, dumped at a temperature of 1382° F., and allowed to cool openly in air.

| Element | Percent by Weight |
|---|---|
| Carbon | 3.11 |
| Silicon | 1.49 |
| Manganese | 0.93 |
| Molybdenum | 0.84 |
| Copper | 1.53 |
| Iron (plus minor sulphur and phosphorous elements) | Balance |

The casting had a Brinnell hardness of 321, and exhibited an acicular microstructure free from undesirable Pearlite and carbides.

As a second example of the specific process, castings were formed with the following composition, tapped into the ladle at a temperature of 2650° F., inoculated with SMZ in the ladle, mold dumped at a casting temperature of 1260° F., and allowed to cool in air.

| Element | Percent by Weight |
|---|---|
| Carbon | 3.30 |
| Silicon | 1.40 |
| Manganese | .85 |
| Molybdenum | .82 |
| Copper | 1.57 |
| Iron (plus minor | |

-continued

| Element | Percent by Weight |
|---|---|
| sulphur and phosphorous elements) | Balance |

The resulting "as cast" acicular iron castings had a Brinell hardness of 332 and exhibited no measurable Pearlite nor carbides.

As a third example of the process, castings made from exactly the same ladle as the preceding example number two were processed identically but dumped or separated from the molds when the castings were only at a temperature of 1130° F. The resulting castings were not acceptable due to having microstructures of predominantly Pearlite and Brinell hardnesses of 262.

The metallurgical process described herein is applicable to other products owing to the good tensile, impact and wear characteristics of the castings.

Whereas specific examples of a single product related to the present invention has been shown and described herein, it should be realized that there may be many modifications, substitutions and alterations thereto.

The embodiments of the invention in which an exclusive property or privilege is claimed are defined as follows:

1. A wear resistant cast iron for use in railroad car trucks and other applications requiring a cast iron possessing enhanced properties of tensile strength and resistance to impact and wear having an "as cast" acicular microstructure substantially free of Pearlite and carbides and which is dumped from its sand mold at a temperature above 1250° F. consisting essentially of the following composition, before the addition of inoculant:

| Element | Percent by Weight |
|---|---|
| Carbon | 3.00–3.30 |
| Silicon | 1.20–1.50 |
| Manganese | 0.85–1.00 |
| Molybdenum | 0.80–0.90 |
| Copper | 1.40–1.60 |
| Iron (plus minor sulphur and phosphorous elements) | Balance |

2. The structure of claim 1 further characterized in that the metal is tapped into the ladle at a temperature in the range of 2600°–2650° F. and poured into molds immediately.

3. The structure of claim 1 further characterized in that the length of time the castings stay in the mold is optimized such that the temperature of the castings at dump is above 1250° F. and preferably around 1400° F.

4. The structure of claim 1 further characterized in that the casting has an "as cast" acicular microstructure containing no more than five percent Pearlite and no more than traces of carbides.

5. The structure of claim 1 further characterized in that the casting is separated from the mold sand after dumping and is permitted to cool individually in ambient temperatures.

6. The structure of claim 1 further characterized in that the casting is separated from the mold sand after dumping and is permitted to cool at a rate so as to avoid transformation into Pearlite.

7. The structure of claim 1 further characterized in that the wear element has a Brinell hardness in the range of 302–415.

8. The structure of claim 1 further characterized in that the casting is poured from a ladle inoculated to avoid undercooling effects.

* * * * *